US005205122A

United States Patent [19]

Wong

[11] Patent Number: 5,205,122

[45] Date of Patent: Apr. 27, 1993

[54] COMBINATION SAND RAKE AND SHOVEL

[75] Inventor: Albert H. Wong, Los Angeles, Calif.

[73] Assignee: Dawn Tozour, Glendale, Calif.

[21] Appl. No.: 768,998

[22] Filed: Sep. 30, 1991

[51] Int. Cl.[5] ..... A01B 1/02; A01B 7/06

[52] U.S. Cl. ..... 56/400.04; 56/400.19; 209/419; 294/51

[58] Field of Search ..... 56/400.01, 400.04, 400.05, 56/400.07, 400.19; 172/371; 209/417, 418, 419; 294/51

[56] References Cited

U.S. PATENT DOCUMENTS 1,094,161 4/1914 Mueller ..... 209/419
1,646,787 10/1927 Elmenthaler ..... 209/419
3,146,831 9/1964 McConnell ..... 56/400.04 X
3,851,763 12/1974 Ball et al. ..... 209/419
3,979,146 9/1976 Berg ..... 209/419 X
4,198,720 4/1980 Matsumoto ..... 209/418 X
4,822,487 4/1989 Soich ..... 209/417 X
4,827,706 5/1989 Meyer et al. ..... 56/400.05
4,828,690 5/1989 Montez ..... 209/418

*Primary Examiner*—George A. Suchfield
*Attorney, Agent, or Firm*—Hawes & Fischer

[57] ABSTRACT

A combination sand rake and shovel providing the ability to clean sandy with a tool having two configurations. When configured as a shovel, the debris may be lifted directly from the sand. When configured as a rake, the debris can be screened in a direction parallel to the grounds surface.

17 Claims, 4 Drawing Sheets

COMBINATION SAND RAKE AND SHOVEL

BACKGROUND OF THE INVENTION

The present invention relates to implements used for tending ground areas, and more particularly to an implement for simultaneously moving and sifting sandy earth.

Ground areas not covered with grass or other plants are particularly noticeable when littered. They have a tendency to collect and hold debris not only on the surface, but to some depth as well. Vigilant policing of sandy ground areas, such as a beach in front of a hotel, can remove the visible debris. But when subsequent winds, pedestrians, and vehicles shift the top surface, additional debris may be exposed. As a result, sandy areas cannot be cleansed of debris by visual inspection and debris collection.

Sandy ground areas can be more thoroughly cleared of debris by using a screening box and shovel. The screening box is typically a shallow rectangularly shaped support having a screen fitted across the bottom. The screening box is elevated onto a support structure leaving the bottom screen portion free from obstruction, or is manually held by one person who performs the screening function. A second person shovels the sandy earth into the screening box, where the sand passes through while the debris remains trapped in the box by the screen for subsequent disposal.

This technique involves the expenditure of significant energy on behalf of the person shoveling the sand. In order to clean large sandy areas, many cubic yards of debris laden soil have to be elevated to the screening box's vertical level, then sifted and respread; the thorough cleaning of a given area requires hours of work.

With the screening box method, time must be taken to separately dump the debris collected from each few shovel-full of sand. If the screening box is not dumped often, two undesirable effects result. As greater amounts of debris begins to collect in the screening box, the debris itself begins to impede the sifting action of the screen and reduces the rate at which sand passes through the screen of the screening box. Secondly, the increased weight of larger amounts of debris, and the increasing weight of the sand which is backed up due to the slower rate of sand passage through the screen of the screening box, imparts tensive stress upon the screen. Tensive stress can result in tearing of the screen or failure of the points of attachment of the screen to the screening box.

What is needed is a device facilitating an easier method for effectively cleaning sandy soil areas of debris, both visible debris at the surface, and hidden debris within the volume. In order to reduce the expenditure of energy, the device should require the sandy soil to undergo a minimum of displacement during the cleaning process, and especially minimum vertical displacement. The needed device should not allow the debris to collect to the point that the cleaning action is impeded. Further the needed device should facilitate easy transfer of the debris into a container without having the operator stop to perform a different function. These and other objects of the present invention will be apparent to one skilled in this art from the following description of a preferred embodiment.

BRIEF SUMMARY OF THE INVENTION

The present invention provides a device which contains a screen surface and which is convertible to be configured as a rake or as a shovel. When configured as a rake, sandy soil can be cleaned of debris occurring above and below the surface by a raking action. When configured as a shovel, sandy soil can be cleaned of debris occurring above and below the surface with a shoveling action.

The lifting of the debris from the sandy soil surface is facilitated in either the rake or shovel configuration. In both configurations, the sandy soil is not significantly vertically displaced above ground level, thus minimizing the energy expenditure by the operator. In either configuration, the operator can easily control the depth of sandy soil which is to be cleaned.

BRIEF DESCRIPTION OF THE DRAWINGS

Other aspects, features and advantages of the invention, its configuration, construction and operation will be best understood from the following detailed description, taken in conjunction with the accompanying drawings in which.

DETAILED DESCRIPTION OF THE PREFERRED EMBODIMENT

Figure 1:
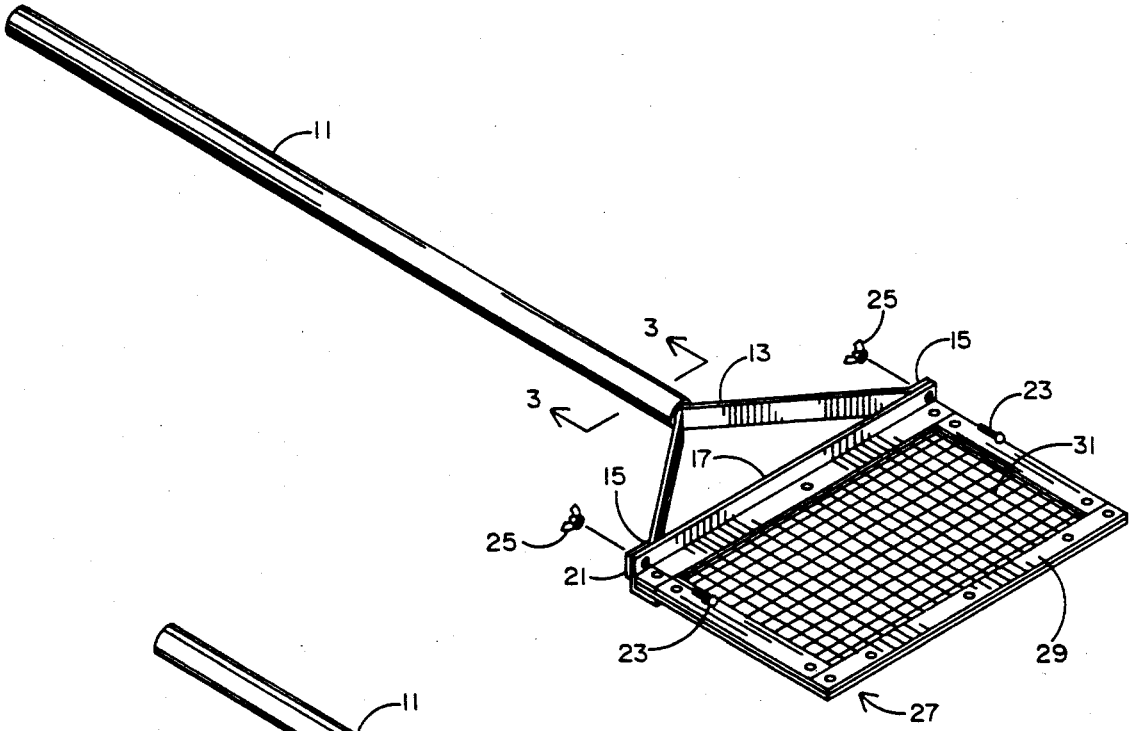
FIG. 1 is a perspective view of the combination sand rake and shovel of the present invention assembled into the shovel configuration.

Referring to FIG. 1, the combination sand rake and shovel of the present invention has an elongate handle 11, engaging a handle support 13. Handle 11 is preferably a section of straight or linear, hollow metallic tube made of aluminum or some other light metal. Handle support 13 may be formed from a single or double length of metallic bar stock, preferably from a strong, light metal. Handle support 13 is attached to handle 11 by extension of portion 14 into handle 11. As the handle support extends away from handle 11 it forms a pair of wings, each of which extend in opposite directions.

The ends of the wings of the handle support 13 are bent slightly to form attachment plates 15 having surface planes generally parallel to each other. Attachment plates 15 flatly abut an elongate edge plate 17 at points near the ends of edge plate 17. Attachment plates 15 each has a pair of apertures 19 near its end, which apertures are in mating alignment with a pair of apertures 21 near the ends of elongate edge plate 17.

A pair of bolts 23 join the elongate edge plate 17 to attachment plates 15 of handle support 13, each of said bolts 23 receiving a wing nut 25. Attached to elongate edge plate 17 is a screen frame member 27. Elongate edge plate 17 may form a portion of the screen frame member 27. The elongate edge plate 17 has a plane which meets the plane of screen frame member 27 at a right angle.

Screen frame member 27 has a frame portion 29 securing a screen portion, or screen 31. Screen 31 is attached to frame portion 29 by any appropriate means such as welding or gluing, but the preferred method is by sandwiching the screen portion 31 between members comprising the frame portion 29.

Figure 2:
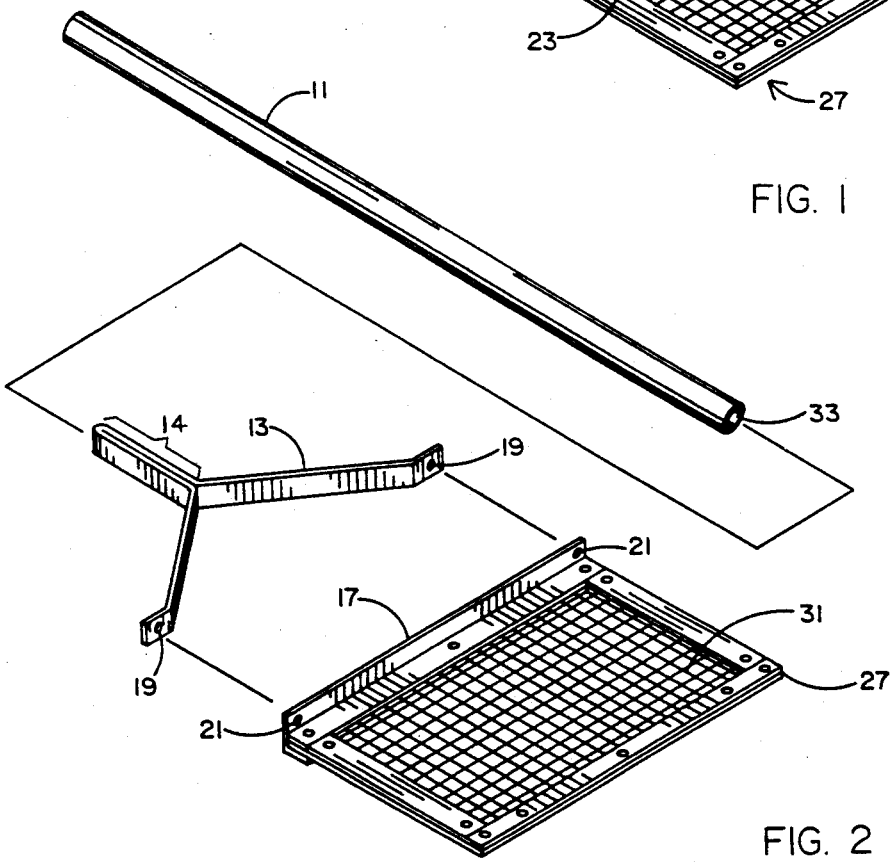
FIG. 2 is a partially exploded view of the combination sand rake and shovel shown in FIG. 1.

Referring to FIG. 2, the handle 11, handle support 13, and edge plate 17 are shown in an exploded relationship. Handle support 13 is seen as being a single length of bar stock folded acutely at the center, although the center folded portion 14 could consist of two individual pieces of bar stock brought together in close proximity. The portion 14 of handle support 13 not forming the oppositely extending wings, is pressed together in close proximity for fitted insertion into the hollow end 33 of handle 11. The manner of insertion of bolts 23 through apertures 19 and 21 of attachment plates 15 and edge plate 17 is clearly shown.

Figure 3:
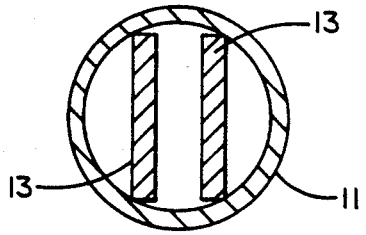
FIG. 3 is a cross-sectional view of the handle of the combination sand rake and shovel taken along line 3—3 of FIG. 1.

Referring to FIG. 3, a cross-sectional view inside handle 11 at line 3—3 of FIG. 1, illustrates the preferred relationship between the internal diameter of handle 11 and the height of the two lengths of handle support 13 which reside within handle 11. The spacing between the two lengths of handle support 13 is dependent upon their height, the higher they are, the closer spacing between them is forced by the internal diameter of handle 11. Consequently, if the correct spacing is selected, the handle support 13 can be further anchored into handle 11 by using a wedge (not shown) inserted into the hollow end 33 of handle 11 between handle support 13, or by using a metal screw on the underside of handle 11 at the appropriate distance from the acute fold of handle support 13 to force the sides of the handle support 13 apart to increase the tightness of fit.

Figure 4:
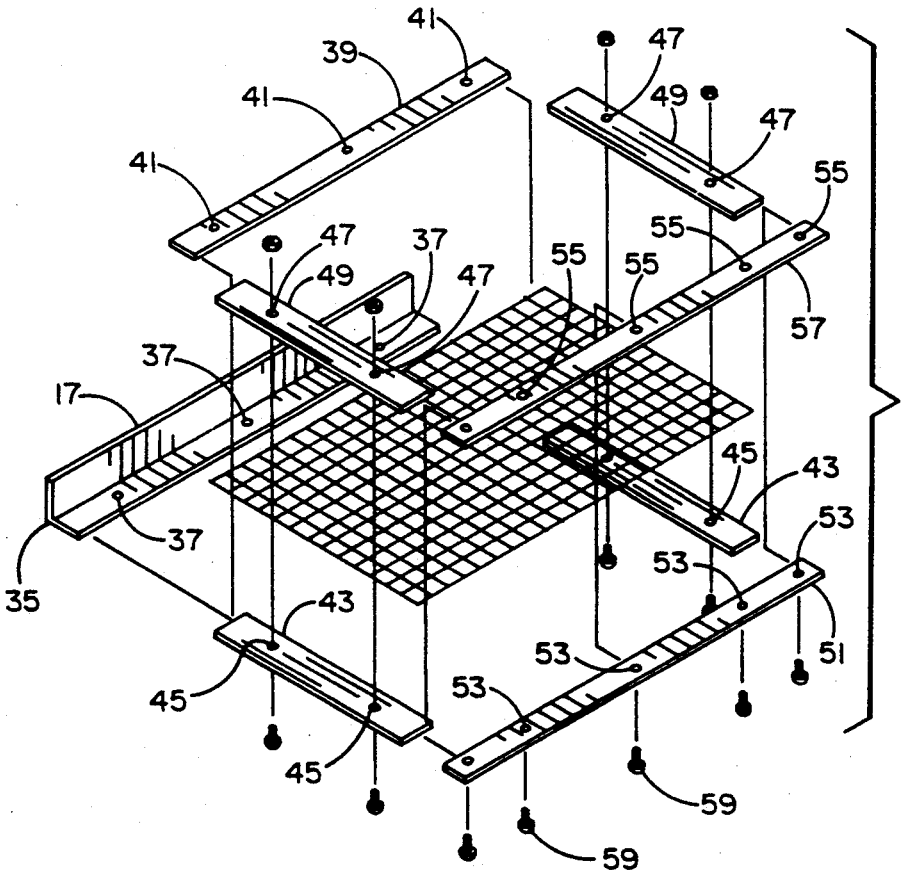
FIG. 4 is an exploded view of the screening frame of the combination sand rake and shovel shown in FIGS. 1 and 2.

FIG. 4, an exploded view of frame portion 29, illustrates one possible configuration of the sand rake/-shovel and its component parts. Here, the edge plate 17 is seen to be one side of an angle beam 35 having a 90° angle between its two planar surfaces. The bottom surface of angle beam 35 has a pair of apertures 37.

A first top frame bar 39 has a pair of apertures 41 in alignment with apertures 37 of the bottom surface of angle beam 35. A pair of side bottom frame bars 43 have apertures 45 which align with apertures 47 in a pair of side top frame bars 49. A front bottom frame bar 51 has apertures 53 in alignment with apertures 55 of a second top frame bar 57.

Screen 31 has edges which rest upon the bottom surface of angle beam 35, side bottom frame bars 43 and front bottom frame bar 51. Resting upon screen 31 and sandwiching screen 31 with respect to bottom surface of angle beam 35, side bottom frame bars 43 and front bottom frame bar 51, are first top frame bar 39, side top frame bars 49, and second top frame bar 57, respectively.

A set of short bolts 59 extend through apertures 37, 41, 45, 47, 53, and 55 to rigidly join, the aforementioned sandwich structure. Alternatively, a plurality of rivets can be used in lieu of short bolts. The ends of side bottom frame bars 43 closest to angle beam 35, overlap the bottom surface of angle beam 45 to lend rigidity and support to the side top frame bars 49.

The mesh size of screen 31 is typically large enough to admit 1/16th bolts through its apertures without damaging the screen. The ideal screen mesh size will be sufficient to permit sand and sandy soil to pass readily through the screen aperture without allowing debris to also pass. The material of screen 31 should also be sufficiently structurally stable to support itself under the stress of a single volume of sand.

Figure 5:
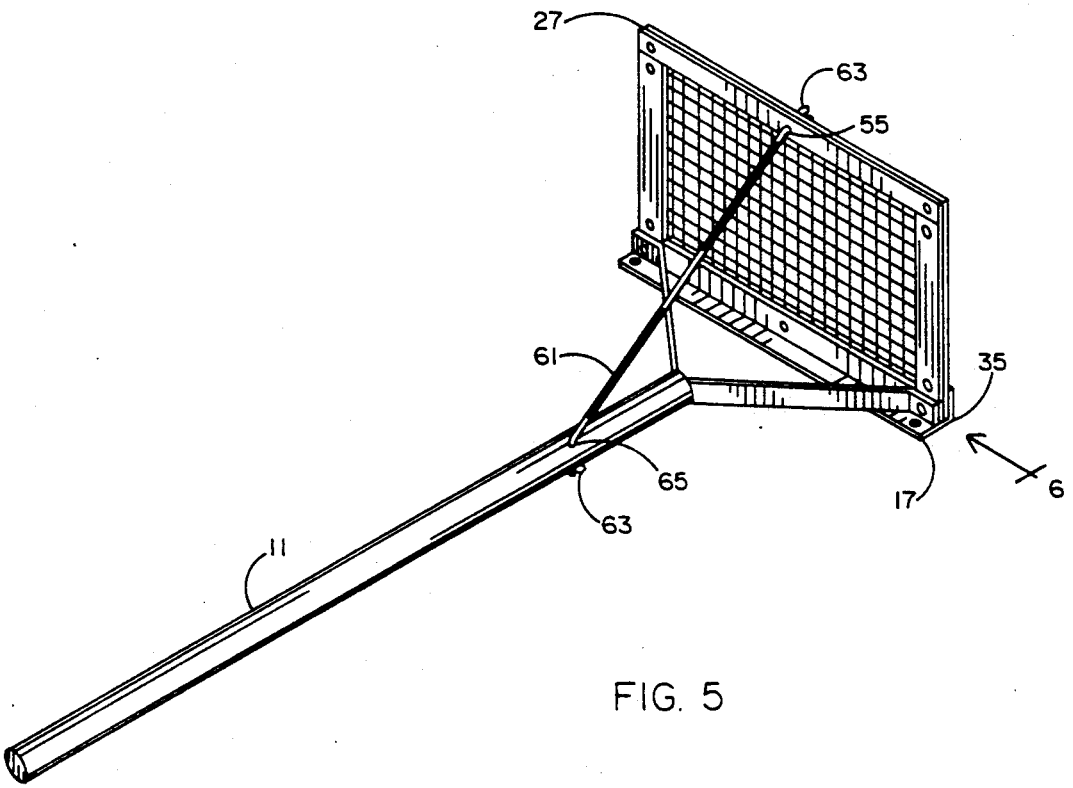
FIG. 5 is a perspective view of the combination sand rake and shovel of the present invention assembled into the rake configuration.

Referring to FIG. 5, the members of FIGS. 1–4 can be repositioned or rearranged into a rake configuration. The handle support 13 has been removed from edge plate 17 of angle beam 35, and now the attachment plates 15 of handle support 13 attachably abut first top frame bar 39. In the configuration of FIG. 5, the apertures 19 are aligned with the apertures 37 and 41 at the outermost ends of angle beam 35 and first top frame bar 39. The same bolts 23 and wing nuts 25 are used to attach handle support 13 to first top frame bar 39 and the bottom of angle beam 35.

In the raking configuration of FIG. 5, as substantial force is applied to handle 11 in a raking type motion, the maximum loading will occur at the edge of screen frame member 27 opposite the edge attached to handle support 13. Consequently, an additional member, namely structural member 61 is attached between the edge of screen frame member 27 opposite the edge attached to handle support 13, and handle 11. Structural member 61 secures the angle of the plane of screen frame member 27 with respect to handle 11. Ideally, for economy, structural member 61 will be a threaded rod having slight bends at its extreme ends so that it may enter frame member 27 and handle 11 perpendicularly.

Structural member 61 is secured by wing nuts 63, one on each end of structural member 61, as structural member extends through aperture 65 in handle 11 and apertures 53 and 55 in front bottom frame bar 51 and second top frame bar 57, respectively. The spacing between the two lengths of handle support 13 within handle 11 shown in FIG. 3 could be created by virtue of the aforementioned metal screw (not shown) securing the handle supports 13 within handle 11, or via the use of a metal sleeve (not shown) pushed between the two lengths of handle support 13 into alignment with aperture 65.

Figure 6:
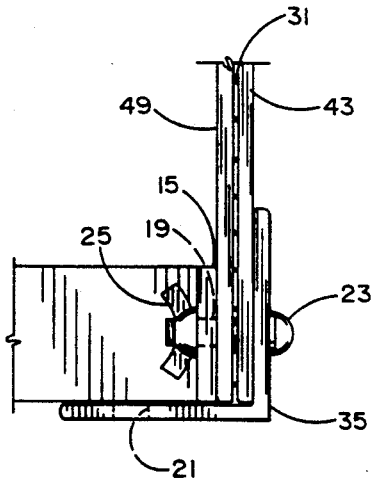
FIG. 6 is a side view of the combination sand rake and shovel shown in FIG. 5, illustrating the details of attachment of the handle support to the screening frame.

Referring to FIG. 6, a side detail of the rake configuration illustrated in FIG. 5, bolts 23 are secured by wing nuts 25 to attachment plates 15 of handle support 13 onto side top frame bars 49 and further onto the bottom surface of angle beam 35. Also visible in phantom are the apertures 19 in the attachment plates 15 of the handle support 13. Apertures 21 on the edge plate 17 portion of the angle beam 35 are also shown in phantom, the apertures 21 to be utilized when screen frame member 27 assumes the shovel configuration of FIGS. 1–4.

In the operation of the combination sand rake and shovel of the present invention, the device of the Figures may be configured as a rake as shown in FIGS. 5 and 6 by inserting bolts 23 through the apertures 37 in the bottom portion of angle beam 35 and apertures 41 in first top frame bar 39 and through apertures 19 in attachment plates 15 and secure the bolts 23 by the wing nuts 25. Next, structural member 61 is extended through aperture 65 in handle 11 and apertures 53 and 55 in front bottom frame bar 51 and second top frame bar 57, respectively. The ends of structural member 61 are then secured with wing nuts 63, and the rake configuration is complete.

Figure 7:
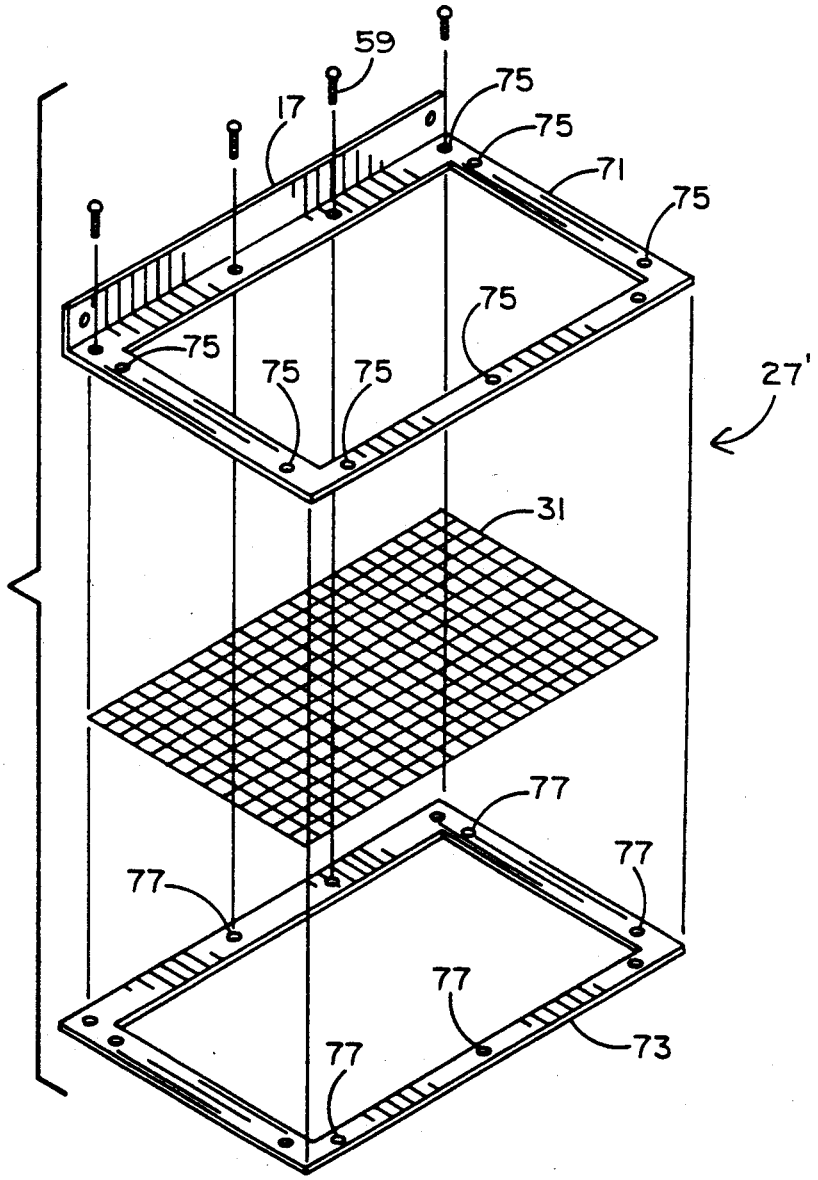

Referring to FIG. 7, an alternate construction of a portion of the sand rake and shovel of FIGS. 1–6 is illustrated. Here, the screen frame member 27' is made of an upper frame 71, including elongated edge plate 17, and a lower frame member 73. Upper frame member 71 has apertures 75 in alignment with apertures 77 on lower screen frame member 73. Screen 31 is sandwiched between the upper frame member 71 and lower frame member 73 and bolted with bolts 59. The use and operation of the screen frame member of FIG. 7 is identical with that of FIGS. 1–6.

The invention now is utilizable as a rake with which to separate debris from sand. In the rake configuration, the device and method of the present invention is pulled through the sand or sandy soil, the debris being urged along by the screen 31 while the sand passes through the screen 31. The angle of attack of the screen frame member 27 with respect to the ground is adjusted by the user by adjusting the horizontal offset angle of handle 11 during the raking motion. A more perpendicular angle with respect to the ground will yield a more shallow insertion of screen frame member 27 into the ground, while a more acute angle will yield a deeper insertion of screen frame member 27 into the ground. The screen frame member 27 can flex somewhat toward the handle 11 when pushed through the sand but its flexing motion away from the handle 11 is limited by structural member 61. This flexing assists in the siting action of screen 31 and assists in the performance of the invention.

With the raking motion, debris may be effectively gleaned from the first three to five inches of sand. The rake configuration facilitates a pulling motion which is not as difficult upon the operator. Very little sand is vertically elevated, thus conserving the user's energy, and increasing both the volume and surface area of sand which can be cleaned. Further, the raking motion facilitates the alignment of the debris along a raking line, which in turn facilitates the movement of the rake to form small piles of debris. This is particularly useful in instances where the volume of debris is small or large areas need to be cleaned, since less time will be spent disposing of a greater number of the smaller piles of debris which would result.

Further, in the operation of the combination sand rake and shovel of the present invention, the device of the Figures may be configured as a shovel as was shown in FIGS. 1–4 by inserting bolts 23 through the apertures 21 in edge plate 17 and through apertures 19 in attachment plates 15 and secure the bolts 23 by the wing nuts 25.

The invention now is utilizable as a shovel with which to pick up debris while letting the sand associated with and surrounding the debris fall through the screen 31. In the shovel configuration, the device and method of the present invention is well adapted to pick up debris lying on or near the surface as a result of using the rake in the raking configuration referred to above. With the shovel configuration, the collected debris, as a result of the raking operation, can be picked up and separated from the surrounding sand in one step. Thus, the only weight of material which it is necessary to lift is that of the debris, not the sand.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed is:

1. A combination sand rake and shovel comprising:
a generally planar frame having at least a first edge;
a screen supported by said frame to form a screen frame member;
handle means;
means attaching said handle means to said first edge of said frame for in either of at least two positions of attachment with respect to said handle for manual operation of said screen frame member, and wherein said handle means is linear and said attaching means attaches said screen frame member to said handle means at a right angle.

2. The combination sand rake and shovel of claim 1 wherein said screen frame member has a second edge opposite said first edge, and further comprising a structural member attached between said second edge of said screen frame member and said handle means.

3. The combination sand rake and shovel of claim 1 wherein said handle means further comprises:
a tubular handle having a hollow end;
a handle support, fittable within said hollow end of said tubular handle, and having a pair of spaced apart attachment plates;
and wherein said attaching means further comprises:
manual attachment means, connected to said first edge of screen frame member and said attachment plates of said handle support, for joining said first edge of said screen frame member to said attachment plates of said handle support.

4. The combination sand rake and shovel of claim 3 wherein said screen frame member has a plurality of spaced apart apertures adjacent said first edge of said screen frame member, and said pair of spaced apart attachment plates each have at least one aperture in alignment with each of said spaced apart apertures of said screen frame member, and wherein said manual attachment means further comprises:
a plurality of bolts, fittable within said plurality of spaced apart apertures and said at least one aperture; and
a plurality of nuts, threadably engagable with said bolts to attach said screen frame member to said attachment plates.

5. The combination sand rake and shovel of claim 4 further comprising:
an edge plate, oriented at a right angle with respect to said screen frame member, and having a lower edge attached to said first edge of said screen frame member, and wherein said edge plate has a plurality of spaced apart apertures which are also alignable with said at least one aperture of said pair of spaced apart attachment plates, said plurality of bolts being fittable within said plurality of spaced apart apertures of said edge plate.

6. The combination sand rake and shovel of claim 5 wherein said nuts are wing nuts.

7. A combination sand rake and shovel comprising:
a generally planar frame having at least a first edge;
a screen supported by said frame to form a screen frame member;
handle means;
means for attaching said handle means to said first edge of said frame in either of at least two positions of attachment with respect to said handle for manual operation of said screen frame member, and wherein in the first position said handle means is linear and said screen frame member is attached to said handle means such that said plane of said screen frame member is parallel to the axis of said handle means, and in the second position said handle means is linear and said screen frame member is attached to said handle means such that said plane of said screen frame member is at a right angle to the axis of said handle means.

8. The combination sand rake and shovel of claim 7 wherein said handle means further comprises:

a tubular handle having a hollow end;

a handle support, fittable within said hollow end of said tubular handle, and having a pair of spaced apart attachment plates;

and in which the screen frame member further comprises:

an edge plate, oriented at a right angle with respect to said screen frame member, and having a lower edge attached to said first edge of said screen frame member;

and in which the attaching means further comprises:

manual attachment means, connected to said edge plate and said attachment plates of said handle support, for joining said edge plate to said attachment plates of said handle support.

9. The combination sand rake and shovel of claim 8 wherein said edge plate has a plurality of spaced apart apertures, and said pair of spaced apart attachment plates each have at least one aperture in alignment with each of said spaced apart apertures of said edge plate, and wherein said manual attachment means further comprises:

a plurality of bolts, fittable within said plurality of spaced apart apertures and said at least one aperture; and a plurality of nuts, threadably engagable with said bolts to attach said edge plate to said attachment plates.

10. The combination sand rake and shovel of claim 9 wherein said nuts are wing nuts.

11. A combination sand rake and shovel comprising:

a frame member further comprising:

a lower screen frame member;

a screen supported by said lower screen frame member;

an upper screen frame member supported by said screen and said lower screen frame member, and joined to said lower screen frame member through said screen;

a handle support, attached to said frame member; and an elongated handle, attached to said handle support.

12. The combination sand rake and shovel of claim 11 wherein said lower and said upper screen frame member has a plurality of apertures, the apertures of said upper screen frame member aligned with the apertures of said lower screen frame member and wherein said lower screen frame member is joined to said upper screen frame member by a plurality of rivets, each said rivet carried in one of said apertures.

13. The combination sand rake and shovel of claim 12 wherein said handle support further comprises a folded length of metallic bar, having a center pressed together portion and wherein each end is formed into an attachment plate, and wherein said elongated handle is in the shape of an open hollow tube at one end, the folded portion of said handle support fitted within said open hollow tube.

14. The combination sand rake and shovel of claim 13 wherein said attachment plates have surface planes generally parallel to each other. handle support further comprises a folded length of metallic bar, having a center pressed together portion and wherein each end has an attachment plate.

15. A method of removing debris from sand comprising the steps of:

providing a linear handle;

attaching a screen frame member at a right angle with respect to said handle, the screen frame member having a screen having a mesh sufficiently large enough to permit sand to freely pass through said screen, yet sufficiently small enough to block debris from passing therethrough; and manually engaging said handle to move said screen frame member through a volume of sand to remove debris in said volume of sand.

16. The method of removing debris from sand as recited in claim 15 wherein said volume of sand has a horizontal upper surface and said screen frame member is declined from the vertical position, with respect to said upper surface of said volume of sand.

17. The method of removing debris from sand as recited in claim 15 and further comprising the steps of:

attaching the screen frame member to said handle such that the plane of said screen frame member is parallel with respect to said handle; and manually engaging said handle to move said screen frame member underneath a volume of sand to lift debris in and on said volume of sand.

* * * * *